US008006623B2

(12) United States Patent
Dupont et al.

(10) Patent No.: US 8,006,623 B2
(45) Date of Patent: Aug. 30, 2011

(54) DUAL-MASS FORWARD AND SIDE FIRING FRAGMENTATION WARHEAD

(75) Inventors: James H. Dupont, Bowie, AZ (US); Henri Y. Kim, Tucson, AZ (US); Travis P. Walter, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 182 days.

(21) Appl. No.: 12/272,020

(22) Filed: Nov. 17, 2008

(65) Prior Publication Data

US 2011/0179966 A1 Jul. 28, 2011

(51) Int. Cl.
*F42B 12/22* (2006.01)
*F42B 12/32* (2006.01)
*F42B 12/58* (2006.01)

(52) U.S. Cl. ..... 102/494; 102/492; 102/496

(58) Field of Classification Search ..... 102/489, 102/491, 492, 494, 495, 506, 496, 497
See application file for complete search history.

(56) References Cited

U.S. PATENT DOCUMENTS 1,216,364 A * 2/1917 Roger ..... 102/364
3,570,401 A 3/1971 Euker
3,646,888 A 3/1972 Posson et al.
3,750,587 A 8/1973 Walde
3,785,293 A 1/1974 Barr et al.
3,818,833 A 6/1974 Throner
3,877,383 A 4/1975 Flatau
3,968,748 A 7/1976 Burford et al.
3,970,005 A 7/1976 Rothman
3,977,327 A 8/1976 Brumfield et al.
3,978,796 A 9/1976 Hackman
4,106,411 A 8/1978 Borcher et al.
4,463,678 A 8/1984 Weimer et al.
4,524,696 A * 6/1985 Altenau et al. ..... 102/491
H540 H 11/1988 Caprioni
4,882,996 A 11/1989 Bock et al.
H1011 H 1/1992 Kline
5,090,324 A 2/1992 Boecker et al.
5,157,225 A 10/1992 Adams et al.
5,313,890 A 5/1994 Cuadros
(Continued)

FOREIGN PATENT DOCUMENTS

DE 3900442 A1 7/1990
(Continued)

*Primary Examiner* — James S Bergin
(74) *Attorney, Agent, or Firm* — Eric A. Gifford

(57) ABSTRACT

A high-lethality fragmentation warhead with reduced risk of collateral damage to the warhead launch platform. High lethality is achieved with a forward-firing fragmentation assembly placed in front of the explosive and a side-firing fragmentation assembly placed in a void space in the aft section of the explosive. The risk of collateral damage to the launch platform is reduced by forming the case and explosive containment structures of materials that are pulverized upon detonation of the explosive. This substantially eliminates radial fragments and in particular fragments thrown back towards the platform. Performance may be enhanced by tapering the aft section of the containment structure and explosive to eliminate explosive that does not contribute to the total energy imparted to the forward-firing fragmentation assembly by the pressure wave to create the void space for the side-firing fragmentation assembly. Performance may be further enhanced by forming the end of the explosive and forward-firing fragmentation assembly with largely conformal dome shapes that approximately match the shape of the front of the pressure wave. This both increases the amount of explosive energy delivered to those fragments and serves to expel them in a desirable pattern.

27 Claims, 10 Drawing Sheets

U.S. PATENT DOCUMENTS

| | | | | |
|---|---|---|---|---|
| 5,320,044 | A | 6/1994 | Walters | |
| 5,323,707 | A | 6/1994 | Norton et al. | |
| 5,337,673 | A | 8/1994 | Koontz et al. | |
| 5,419,024 | A | 5/1995 | Koontz et al. | |
| 5,544,589 | A | 8/1996 | Held | |
| 5,668,346 | A | 9/1997 | Kunz et al. | |
| 6,276,278 | B1 * | 8/2001 | Korpe | 102/492 |
| 6,484,642 | B1 | 11/2002 | Kuhns et al. | |
| 6,758,143 | B2 | 7/2004 | Ritman et al. | |
| 7,004,075 | B2 | 2/2006 | Ronn et al. | |
| 2006/0266247 | A1 | 11/2006 | Gilliam et al. | |

FOREIGN PATENT DOCUMENTS

| | | | |
|---|---|---|---|
| DE | 4011243 | C1 | 5/1996 |
| DE | 4238482 | A1 | 3/1999 |
| DE | 19749168 | A1 | 5/1999 |

* cited by examiner

DUAL-MASS FORWARD AND SIDE FIRING FRAGMENTATION WARHEAD

RELATED APPLICATION INFORMATION

This patent is related to a co-pending application U.S. Ser. No. 12/123,158, filed May 19, 2008, entitled "High-Lethality Low Collateral Damage Fragmentation Warhead".

BACKGROUND OF THE INVENTION

1. Field of the Invention

This invention relates to fragmentation warheads and in particular to a dual-mass fragmentation warhead that expels a mass of fragments in a forward-firing pattern and a mass of fragments in a side-firing pattern.

2. Description of the Related Art

Fragmentation warheads expel metal fragments upon detonation of an explosive. Fragmentation warheads are used as offensive weapons or as countermeasures to anti-personnel or anti-property weapons such as rocket-propelled grenades. The warheads may be launched from ground, sea or airborne platforms. A typical warhead includes an explosive inside a steel case. A booster explosive and safe and arm device are positioned in the case to detonate the explosive.

A radial blast fragmentation warhead includes a steel case that has been pre-cut or scored along the length of the explosive. The booster explosive is positioned in a center section of the case. Detonation of the explosive produces a gas blast that emanates radially from the center point pulverizing the case and expelling the pre-cut metal fragments in all directions in a generally spherical pattern. Although lethal, the radial distribution of the fragments also presents the potential for collateral damage to friendly troops and the launch platform.

A forward blast fragmentation warhead includes a fragmentation assembly placed in an opening in a fore section of the steel case against the flat leading surface of the explosive. The fragmentation assembly will typically include 'scored' metal or individual pre-formed fragments such as spheres or cubes to control the size and shape of the fragments so that the fragments are expelled in a somewhat predictable pattern and speed. Scored metal produces about an 80% mass efficiency while individual fragments are expelled with mass efficiency approaching 100% where mass efficiency is defined as the ratio of fragment mass expelled (therefore effective against the intended target) to the total fragment mass. In other words, the mass efficiency is the ratio of the total mass less the interstitial mass that was consumed during the launch process (therefore ineffective against the intended target) to the total mass.

In the forward blast warhead the booster explosive is positioned in an aft section of the case. The steel case confines a portion of the radial energy of the pressure wave (albeit for a very short duration) caused by detonation of the explosive and redirects it along the body axis of the warhead to increase the force of the blast that propels the metal fragments forward with a lethality radius. The lethality radius is defined as the radius of a virtual circle composed of the sum of all lethal areas (zones) meeting a minimum lethal threshold for a specified threat. These fragments are generally expelled in a forward cone towards the intended target. The density of fragments per unit area is maximum near zero degrees and falls off with increasing angle with tails that extend well beyond the desired cone. As a result, the warhead has a maximum lethality confined to a very narrow angle and expels a certain amount of lethal fragments outside the desired target area that may cause collateral damage. As a result, the aimpoint and detonation timing tolerances to engage and destroy the threat while minimizing collateral damage are tight.

Detonation of the high explosive produces a gas blast that has a much smaller lethality radius in all directions caused by the pressure wave of the blast. The detonation also tears the steel case into metal fragments of various shapes and sizes that are thrown in all directions, beyond the lethality radius of the gas blast. Detonation of the steel case increases the potential for collateral damage to friendly troops and the launch platform.

SUMMARY OF THE INVENTION

The present invention provides a high lethality fragmentation warhead with reduced risk of collateral damage to the warhead launch platform.

In an embodiment, an explosive containment structure that contains the explosive is placed inside a case, the containment structure and case being formed of materials that are pulverized upon detonation of the explosive by an initiator. An aft section of the containment structure defines a void space between the case and the containment structure. A side-firing fragmentation assembly in the void space expels metal fragments in a side-firing pattern upon detonation of the explosive. A forward-firing fragment assembly positioned in front of the explosive expels metal fragments in a forward-firing pattern upon detonation. The combination of forward and side-firing patterns provides a high lethality warhead. The substantial elimination of metal fragments expelled radially in all directions, particularly backwards, reduces the risk of collateral damage to the warhead launch platform. The forward and side-firing fragmentation assemblies may be configured to control the respective firing patterns (e.g. fragment velocity, half-angle and uniformity of fragments).

In another embodiment, an explosive containment structure is placed inside a case, the containment structure and case being formed of materials that are pulverized with a mass efficiency no greater than 1% upon detonation of the explosive. A tapered aft section of the containment structure defines a tapered void space between the case and the containment structure. An explosive having a fore section with a diameter conformal with the case and a dome-shape end and a tapered aft section is fit inside the containment structure. An initiator aft of the explosive initiates detonation of the explosive at the end of the taper. A side-firing fragmentation assembly in the tapered void space expels pre-formed metal fragments in a side-firing pattern with a mass efficiency of at least 70% upon detonation of the explosive. A forward-firing fragmentation assembly positioned in the opening fore of the explosive includes a dome-shaped layer of pre-formed metal fragments that expels metal fragments in a forward-firing pattern with a mass efficiency of at least 70% upon detonation of the explosive. Detonation of the explosive produces a pressure wave that propagates forward through the tapered explosive. The taper is suitably optimized to maximize the void space without reducing the total explosive energy imparted to the forward-firing fragmentation assembly. The dome-shaped layer is approximately matched to the shape of the front of the pressure wave incident on the layer of pre-formed metal fragments to increase fragment velocity and uniformity over the pattern.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a high-lethality fragmentation warhead with reduced risk of collateral damage to the warhead launch platform. High lethality is achieved with a forward-firing fragmentation assembly placed in front of the explosive and a side-firing fragmentation assembly placed in a void space in the aft section of the explosive. The risk of collateral damage to the launch platform is reduced by forming the case and explosive containment structures of materials that are pulverized upon detonation of the explosive. This substantially eliminates radial fragments and in particular fragments thrown back towards the platform. Performance may be enhanced by tapering the aft section of the containment structure and explosive to eliminate explosive that does not contribute to the total energy imparted to the forward-firing fragmentation assembly by the pressure wave to create the void space for the side-firing fragmentation assembly. Performance may be further enhanced by forming the end of the explosive and forward-firing fragmentation assembly with largely conformal dome shapes that approximately match the shape of the front of the pressure wave. This both increases the amount of explosive energy delivered to those fragments to increase their velocity and serves to expel them in a desirable pattern (e.g. half-angle and uniformity of fragment density over the half-angle).

The dual-mass fragmentation warhead was developed as a short-range, low-speed countermeasure for airborne launch platforms (e.g. helicopters) to intercept and destroy threats such as rock-propelled grenades (RPGs), unguided rockets or ManPADS while minimizing the risk of collateral damage to the platform. Due to limited armor protection, airborne launch platforms are typically more susceptible to damage from stray fragments than land or sea-based system. The dual-mass fragmentation warhead is however adaptable to a wide-range of battle field scenarios to include any type of land, sea, air or spaced-based launch platforms and longer-range, higher-speed engagements. The warhead may be configured for use as an offensive weapon or for countermeasures.

The fragmentation warhead can be used in conjunction with a wide range of interceptors including projectiles and self-propelled missiles and spinning or non-spinning and various guidance systems. The aiming and detonation sequence may be computed and loaded into the interceptor prior to firing. For example, in a close-range countermeasure system, the guidance system will determine when to fire a sequence of motors on the interceptor and when to detonate the warhead. This sequence is loaded into the interceptor prior to launch. A more sophisticated longer range missile might fly to a target and compute its own aiming and detonation sequences or have those sequences downloaded during flight.

Figure 1:
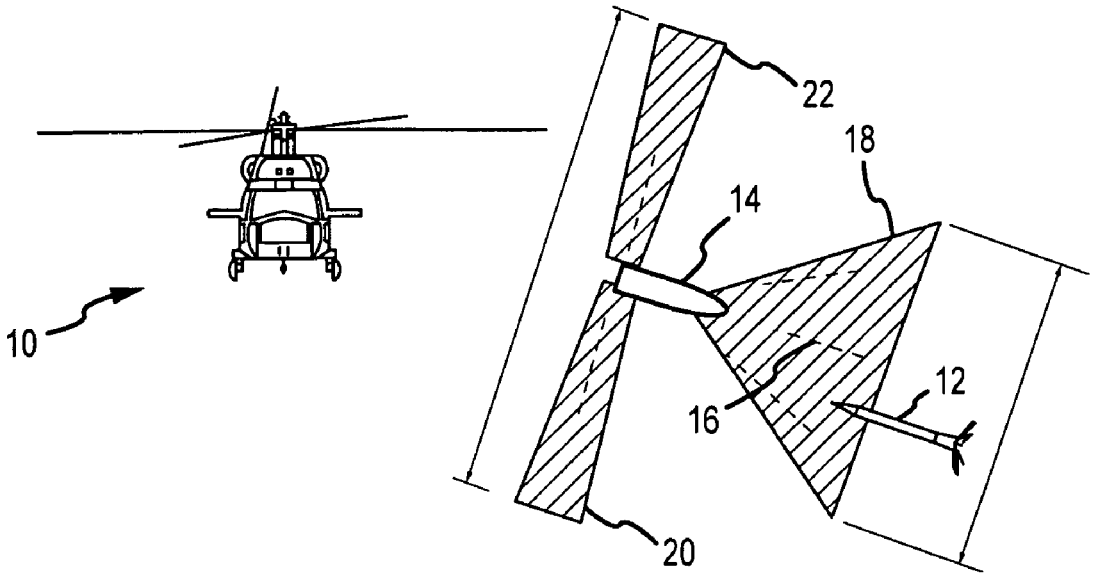
FIG. 1 is a diagram of the blast pattern of a dual-mass forward and side firing fragmentation warhead to engage a threat.

A typical scenario for the use of a dual-mass fragmentation warhead from a launch platform to intercept and destroy a threat is illustrated in FIG. 1. A helicopter 10 detects a threat 12 and launches a missile that includes an interceptor (not shown) and a dual-mass warhead 14 to intercept the threat. The dual-mass warhead 14 detonates expelling a first mass of fragments 16 in a forward-firing pattern 18 and a second mass of fragments 20 in a side-firing pattern 22. The forward and side-firing patterns provide two opportunities to intercept and destroy threat 12. The warhead casing and containment structures are formed of materials that are pulverized upon detonation. The half-angle of the side-firing pattern 22 is sufficiently small that metal fragments 20 are directed away from helicopter 10. This reduces the risk of stray fragments flying back towards the helicopter.

Figures 2A, 2B:
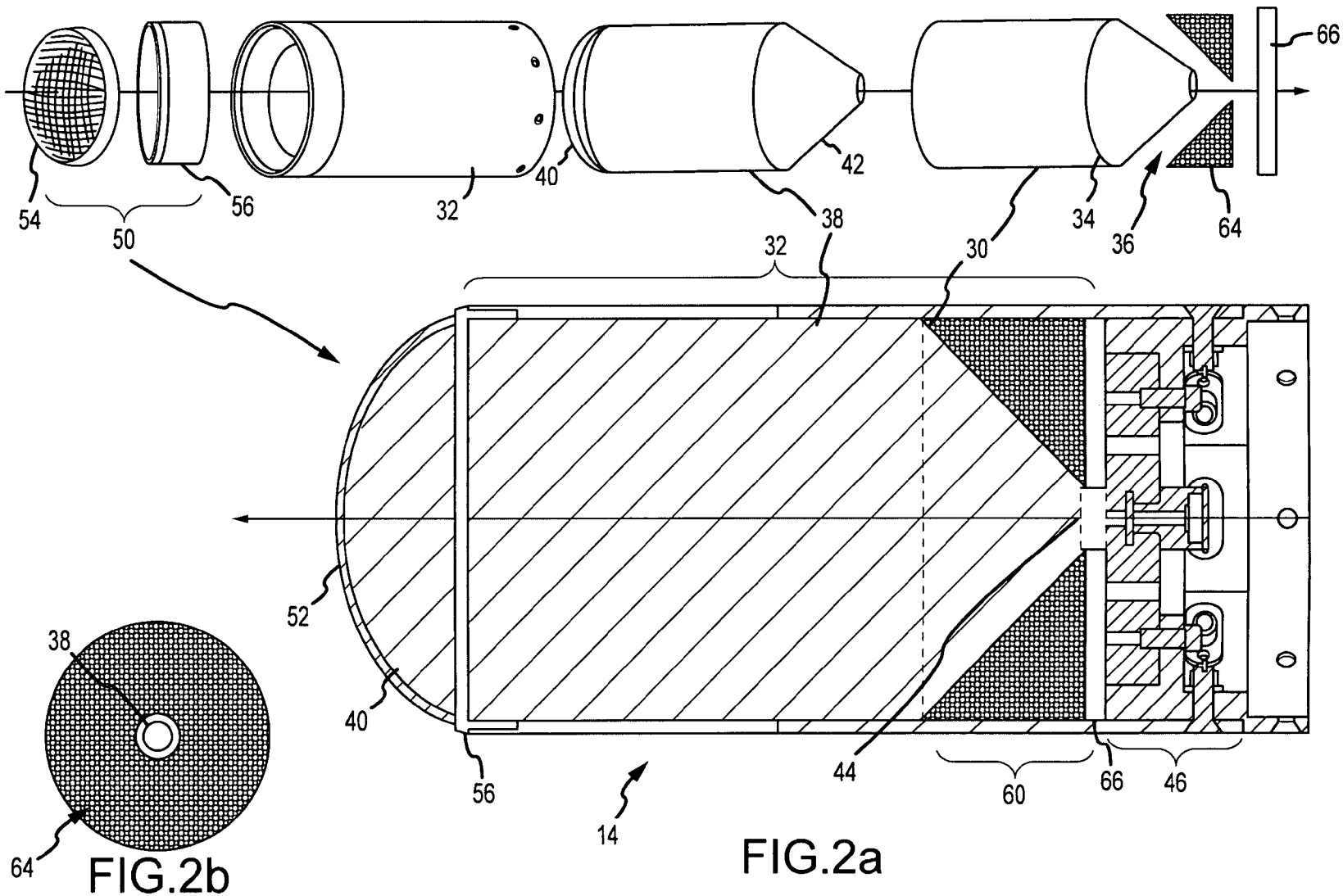
FIGS. 2*a* and 2*b* are side section and bottom views of an embodiment of a dual-mass forward and side firing fragmentation warhead.

As shown in FIGS. 2*a* and 2*b*, an embodiment of dual-mass warhead 14 includes an explosive containment structure 30 placed inside a case 32. A tapered all section 34 of the containment structure defines a tapered void space 36 between the case and the containment structure. An explosive 38 having a fore section with a diameter conformal with the case and a dome-shape end 40 and a tapered aft section 42 is fit inside the containment structure. The dome-shaped end 40 of the explosive suitably extends beyond an opening in the containment structure and case. An initiator 44 (a small booster charge) placed all of the explosive initiates detonation of the explosive at the end of the taper. This type of single-point detonation is typical for these types of warheads. Other multi-point configurations may be used. A safe and arm device 46 is positioned to ignite the booster when commanded. The containment structure and case are formed of materials such as a fiber reinforced composite, engineered wood, thermoplastic (resin, polymer), or even foam that are pulverized with a mass efficiency suitably no greater than 1% upon detonation of the explosive. As a result, the pulverized case material suitably has a lethality radius no greater than the lethality radius due to the pressure wave of the detonated explosive.

A forward-firing fragmentation assembly 50 is positioned in the opening around the dome-shaped end of the explosive. The assembly suitably includes a dome-shaped layer 52 of metal fragments 54 that are expelled in the forward-firing pattern with a mass efficiency of at least 70% upon detonation of the explosive. Pre-formed fragments are generally preferred because they have a known size and shape upon detonation and retain a mass efficiency near 100%. The fragments may be shaped (rectangular, square or other unique shapes) for a particular threat. For ease of assembly the fragments are typically formed in a mold held by an epoxy that is pulverized on detonation.

As will be described in more detail with reference to FIGS. 4-6, in a directional firing fragmentation assembly, the warhead and fragmentation assemblies are preferably configured to control the velocity of the expelled fragments, the half-angle of the pattern and the uniformity of the density of the expelled fragments over the half-angle. In the forward-firing fragmentation assembly 50 the provision of a dome-shaped explosive 38 and a dome-shaped layer 52 of fragments effectively addresses all three parameters. First, in a conventional warhead of this type an aerodynamic nose cone is placed over the flat leading surface of the warhead to provide aerodynamic stability. At typical velocities for short-range countermeasures, a semi-blunt or dome shape is used. In this embodiment, the explosive is extended to fill the dead space and the conformal fragment layer provides the aerodynamic surface. The additional explosive volume imparts greater total energy to the fragments thereby increasing their velocity. Second, as the simulation results will show the curvature of the dome is suitably selected to approximately match the shape of the pressure wave. As a result, the metal fragments are expelled in a well-defined cone with improved density uniformity. In higher velocity warheads, the explosive and fragmentation layer may be shaped to match the front of the pressure wave and a more pointed aerodynamic nose cone placed over the warhead for aerodynamic considerations.

A containment ring 56 may be placed around the periphery and aft of the dome-shaped layer. This ring provides a degree of confinement of the pressure wave to direct fragments axially instead of radially. The ring contains the explosive blast momentarily (e.g. a few milliseconds) but long enough to direct the pressure wave in a forward direction before the ring is itself pulverized. The ring contributes to reducing or eliminating any tails of the pattern beyond the prescribed half-angle. The ring may be extended forward to provide additional confinement to narrow the half-angle as desired. The ring could be extended to span the entire length of the case. A variable-thickness pattern shaper may be inserted between the explosive and fragment layer to slow portions of the wave front to further shape the forward-firing pattern.

A side-firing fragmentation assembly 60 is positioned in the tapered void space 36 around the aft section 42 of explosive 38. The assembly suitably includes a volume of metal fragments 64 that are expelled in the side-firing pattern with a mass efficiency of at least 70% upon detonation of the explosive. Pre-formed fragments are generally preferred because they have a known size and shape upon detonation and retain a mass efficiency near 100%. The fragments may be shaped (rectangular, square or other unique shapes) for a particular threat. For ease of assembly the fragments are typically formed in a mold held by an epoxy that is pulverized on detonation. The relative size, shape and number of fragments in the forward and side-firing assemblies may be configured for a particular threat. In a typical embodiment, the pre-formed fragments in the side-firing assembly are suitably smaller in size and greater in number than the pre-formed fragments in the forward-firing assembly in order to maximize fragment packaging density and increase the number of fragments in the lethality cone "pattern density".

In general, the side-firing pattern can be more difficult to control than the forward-firing pattern and thus typically will have a larger half-angle. As will be shown in the simulations, the pressure wave in the aft section of the explosive tends to move in a generally sideways or lateral direction expelling the metal fragments in the side-firing pattern. The taper of the containment structure and the mass of the safe and arm device and interceptor behind the side-firing fragmentation assembly provide a measure of confinement to control the half-angle. A base plate 66 may be placed between the assembly and the safe and arm device to provide additional confinement to prevent fragments from being expelled backwards. Additional confinement can be achieved by placing one or more containment rings fore or aft of the side-firing fragmentation assembly.

One might assume that in this configuration the forward and side-firing patterns would be initiated simultaneously or that the side-firing pattern, given its proximity to the aft detonation, would actually occur slightly prior to the forward-firing pattern. In a typical engagement scenario like that shown in FIG. 1 where the threat would first encounter the forward-firing pattern and then the side-firing pattern this could be problematic to achieve effective lethality and might suggest that a dual-mass warhead would not improve lethality. As the simulation results will show, in the configuration shown in FIG. 2*a* the pressure wave actually travels forward and expels the fragments in the forward-firing pattern prior to expelling the fragments in the side-firing pattern. For a given warhead design and threat scenario, the degree of the delay can be controlled. For example, to increase the delay the thickness of the casing around the side-firing fragmentation assembly can be increased. Alternately, a dual-detonation configuration can be employed that speeds the detonation of the fore section of the explosive. If desired, other detonation configurations may be employed or detonation of the forward-firing pattern delayed such that the side-firing pattern is released at the same time or even prior to the forward-firing pattern.

One might further assume that the removal of a portion of explosive 38 to create the tapered void space would reduce the total energy imparted to the forward-firing fragmentation assembly and degrade the lethality of the weapon. However, as the simulations will again demonstrate, for an L/D (length/diameter) optimized forward-firing aft-initiated warhead a tapered aft portion of the explosive represents "dead" volumetric space. In other words, explosive in that space does not contribute to the total energy in the forward propagating wave. Essentially the single-point detonation expands as the pressure wave moves forward until it fills the diameter of the casing. Suitably, the taper of the containment structure and explosive are optimized for a given warhead to maximize the tapered void space without reducing the total energy in the forward propagating pressure wave. In a particular warhead for a particular threat, the void space could be enlarged to increase the available volume of metal fragments for side firing at the cost of energy, hence velocity of the fragments expelled in the forward pattern. Alternately, the void space could be decreased to accommodate a reduced mass of fragments for a side-firing pattern.

In warhead analysis, the detonation pressure wave is simulated using CTH analysis models. FIGS. 3*a* through 3*e* show the detonation pressure wave 70 from detonation of an explosive 71 through expulsion of the metal fragments in the forward-firing pattern and then side-firing pattern. The CTH analysis models a dual-mass warhead 72 shown in FIG. 3*a* that includes a dome-shaped layer 74 of pre-formed fragments and pre-formed fragments 76 in the aft tapered void. The curvature of the dome-shaped layer conforms to the front 77 of the pressure wave. A base plate 78 is positioned aft and a containment ring 80 is around the periphery of the dome-shaped layer. The design of the explosive is optimized to a warhead's length to diameter ratio. In this case L/D=1 and the taper is 45 degrees. For a forward firing warhead, increasing the length much beyond an L/D of 1 (i.e. L/D>1) produces only incremental improvements in the fragment velocity or warhead lethality against the threat. However, should the L/D be >1, the taper angle can be increased to optimize for an explosive length of 1 (or L/D of 1), thus reducing the explosive content for cases where L/D>1.

Figure 3A:
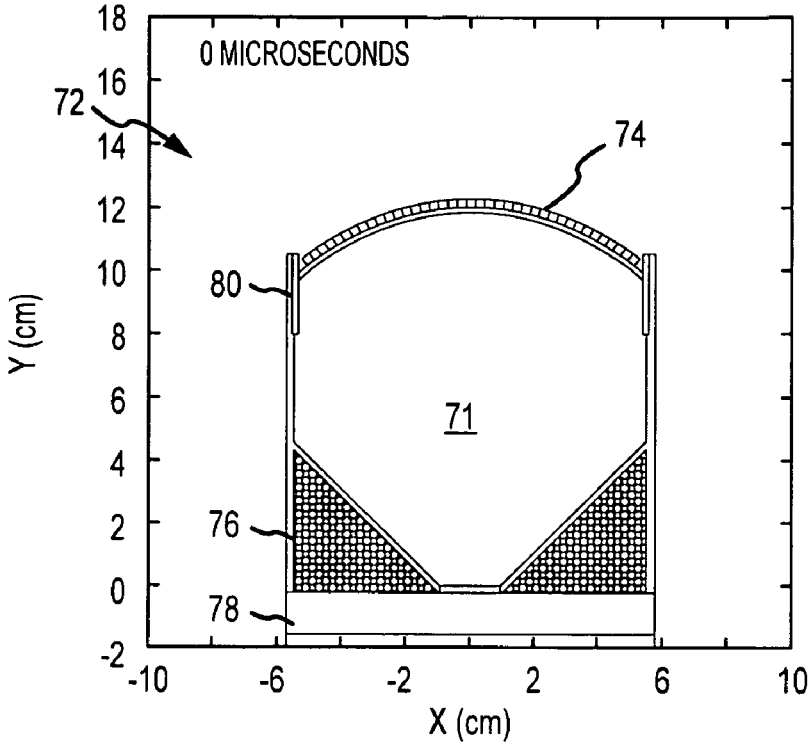
FIGS. 3*a* through 3*e* are plots of the gas blast propagation to expel the fragments in the forward-firing and side-firing patterns.
Figure 3B:
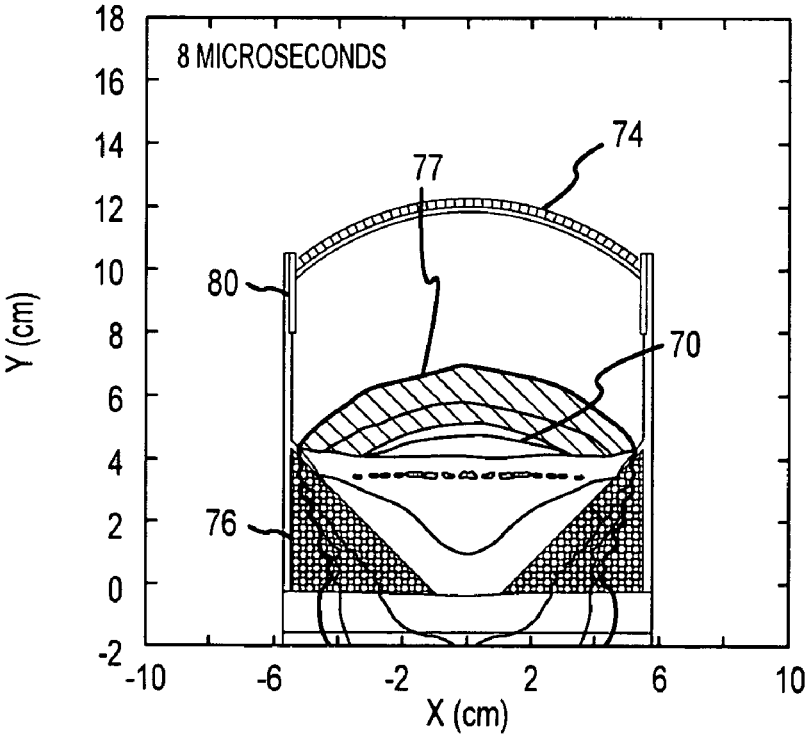

As shown in FIG. 3*b* at t≈8 microseconds, the front 77 of pressure wave 70 moves forward from the single initiation point through the taper and expands to fill the diameter of the explosive at the opposing end of the taper. The highest pressure exists at the wave front 77. The pressure in the aft section is much lower.

Figure 3C:
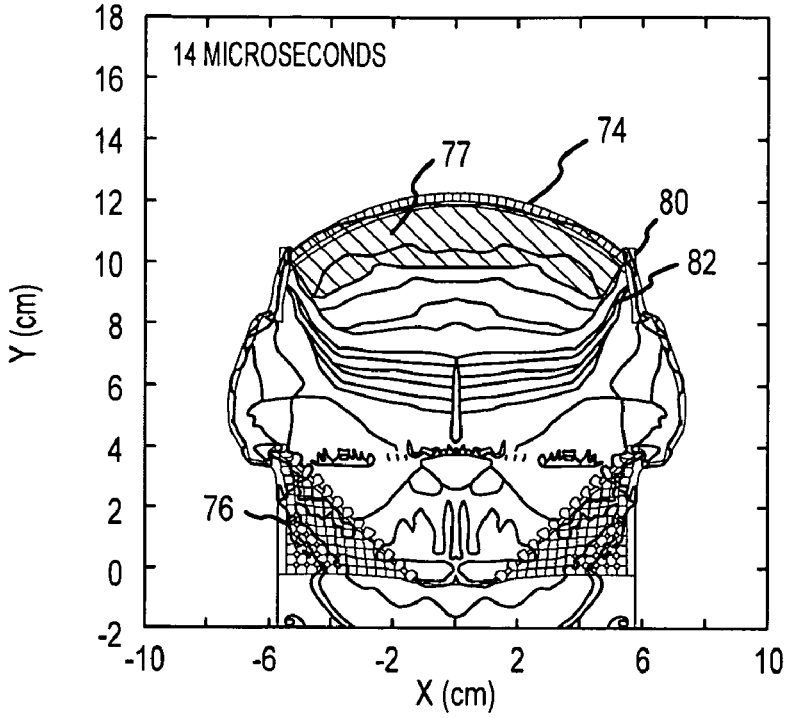

As shown in FIG. 3*c* at t≈14 microseconds, the high pressure wave front 77 has reached the dome-shaped layer 74. The shape of the wave front substantially conforms to the shape of the layer. Containment ring 80 momentarily confines the pressure wave in region 82 thereby directing the pressure wave forward. At this point, the casing materials have begun to pulverize and the forward-firing fragment layer 74 will be expelled instantaneously. However, the pressure in the aft section remains low and the side-firing fragments 76 intact.

Figure 3D:
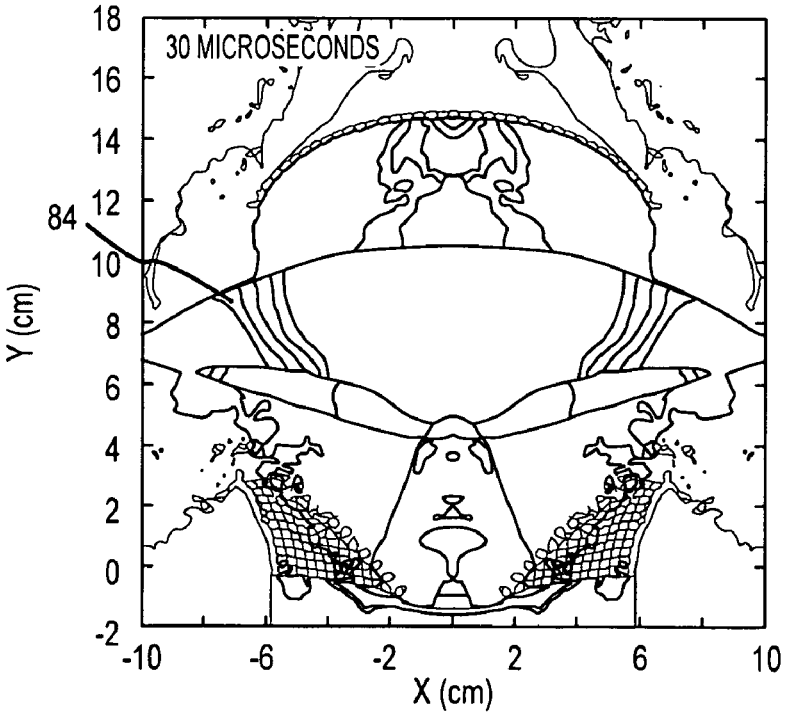

As shown in FIG. 3*d* at t≈30 microseconds, the dome-shaped layer 74 have been expelled forward and the high pressure front of the wave dissipated. The casing is in the process of being pulverized yet side-firing fragments 76 remain largely intact. The absence of metal fragments in a central section 84 of the warhead may be important to limit collateral damage to the launch platform. CTH analysis of conventional radial warheads reveals that it is the central fragments that are often thrown backwards by the pressure wave.

Figure 3E:
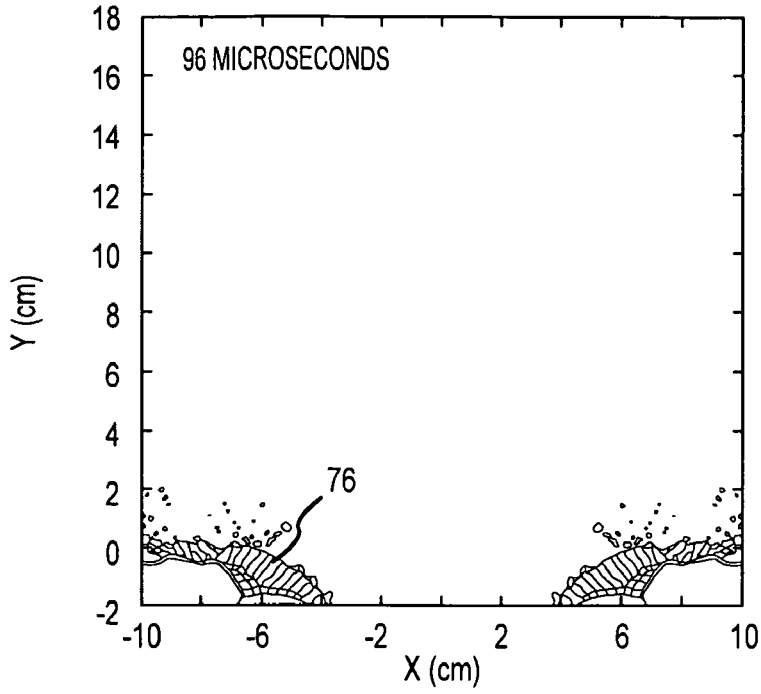

As shown in FIG. 3*e* at t≈96 microseconds, the pressure wave has dissipated and most of the side-firing fragments 76 have been expelled in the side-firing pattern.

The CTH analysis model clearly demonstrates (a) that the proper tapering of the explosive and containment structure to create the void space for the side-firing fragmentation assembly does not degrade the forward energy of the pressure wave, (b) that conforming the shape of the forward-firing fragmentation layer to the shape of the pressure wave front increases fragment velocity and pattern uniformity, (c) that the pressure wave will expel fragments 76 in a side-firing pattern and (d) that the side-firing pattern can be delayed with respect to the forward-firing pattern. Other warhead configurations and configurations of the forward and side-firing fragmentation assemblies may be employed within the scope of the dual-mass warhead architecture.

Figure 4:
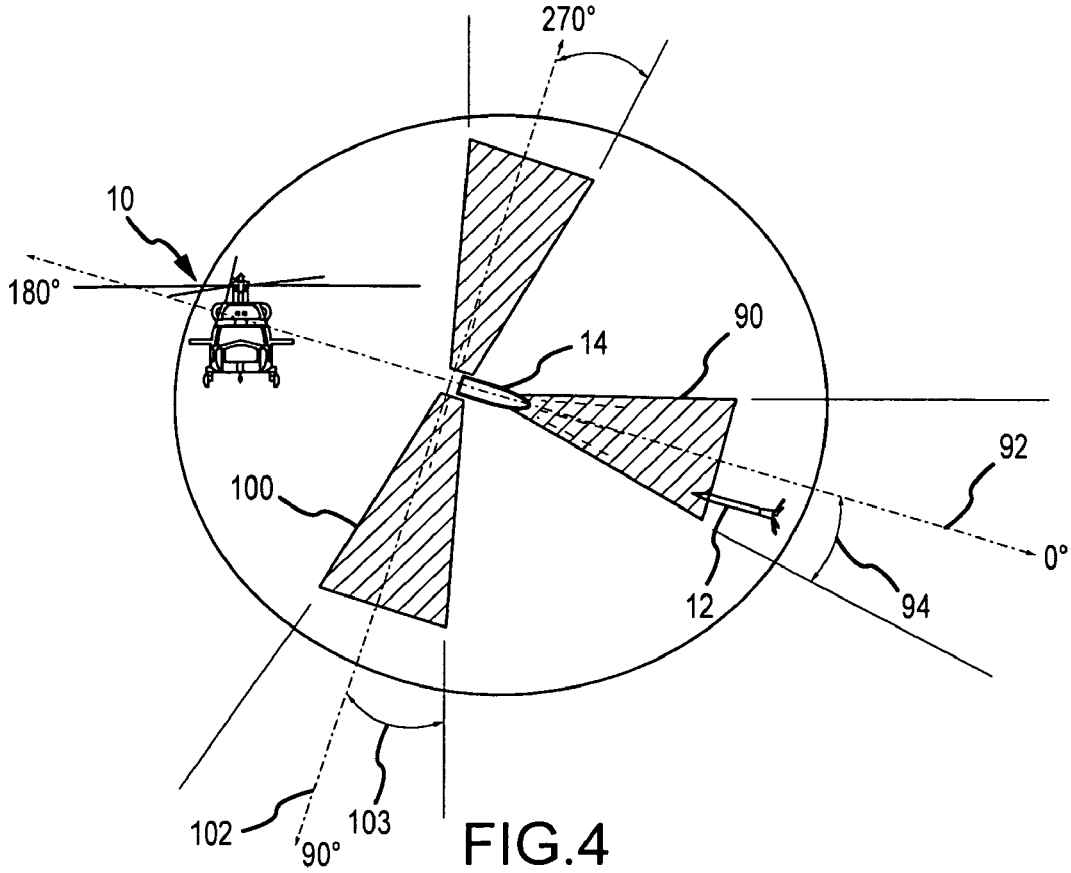
FIG. 4 is a diagram of the blast pattern illustrating the half-angles of the forward and side-firing patterns for a particular embodiment.

FIG. 4 illustrates the directional blast patterns of dual-mass warhead 14 launched from helicopter 10 to engage threat 12. The forward-firing blast pattern 90 has a generally 3D conical shape that initiates at the front of the warhead and extends forward about the long axis 92 of the warhead. The "half-angle" 94 of the cone is defined where the pattern is lethal to a specified threat at a specified distance. Of course there will be stray fragments that lie outside the half-angle of the cone, perhaps as much as 10 degrees to either side. The half-angle of the forward-firing pattern has a minimum of approximately 3 degrees and a maximum of approximately 45 degrees with typical values of 10-20 degrees. The half-angle will depend on warhead optimization issues, the threat, engagement scenario, guidance and control capability and collateral damage risks. The side-firing blast pattern 100 has a generally 3D annular conical shape that initiates around the circumference at the aft section of the warhead and extends outward about an axis 102 approximately orthogonal to long axis 92. The half-angle 103 of the side-firing pattern has a minimum of approximately 10 degrees and a maximum of approximately 45 degrees with typical values of 25-35 degrees. A central region between the forward and side-firing patterns is largely devoid of any metal fragments, occupied only by the pulverized casing materials.

The threat detection, guidance, navigation and control systems either on the launch platform or the interceptor delivering the warhead generate a firing solution to destroy the threat. That solution has a composite system error which means there is an aiming error that can be translated into an area or volume. The area or volume of the forward and side-firing patterns is typically 1,000 times or larger than the presented area of the target. The fragmentation warhead must engage the entire area or volume with lethal force to destroy the threat. The area or volume and the lethality requirement per threat determine the number of fragments that must be expelled. Typically the threat can be in any place within the volume with equal probability. In this case, the fragmentation warhead is suitably designed to expel metal fragments having an approximately uniform pattern density (# fragments per unit area) over the prescribed half-angle of the volume and preferably no further (a certain percentage of fragments will stray outside the volume). If the threat is not placed in the volume with equal probability but is skewed in some manner, the fragmentation warhead is suitably designed to match that distribution.

Figure 5B:
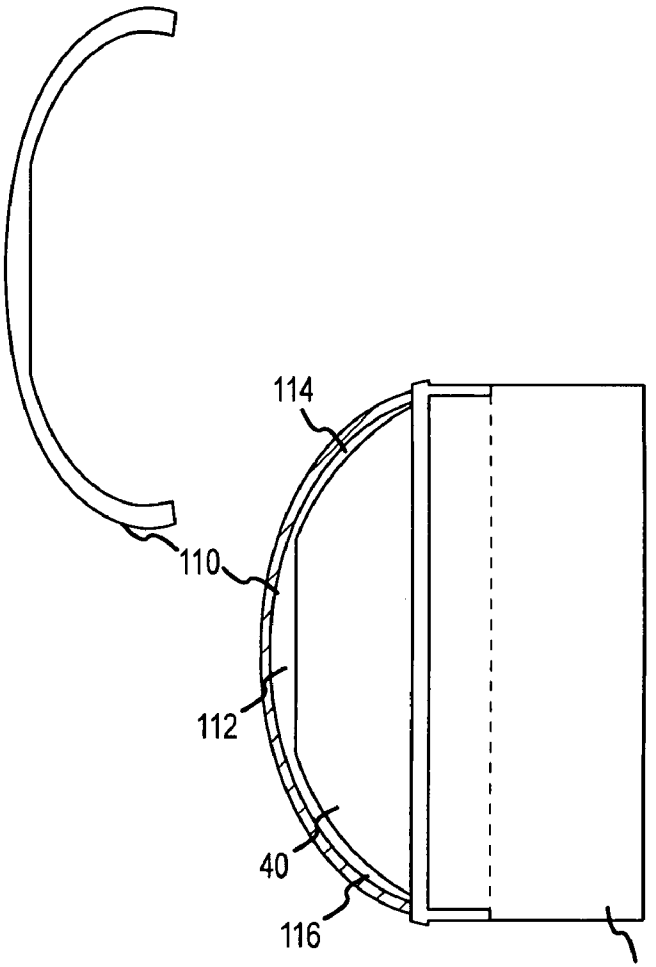
FIGS. 5*a* through 5*c* are diagrams of embodiments of the forward-firing fragmentation assembly to control the half-angle of the forward-firing pattern.
Figure 5A:
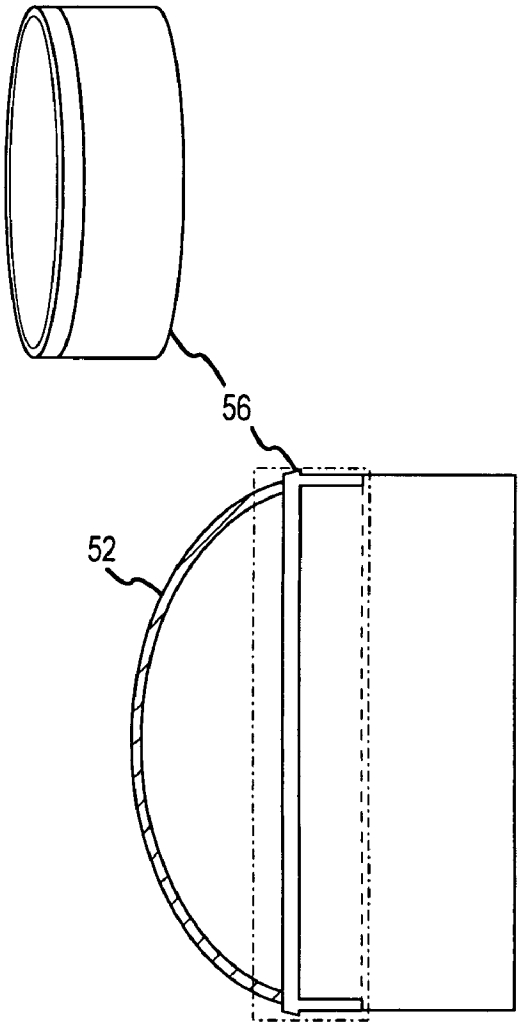
Figure 5C:
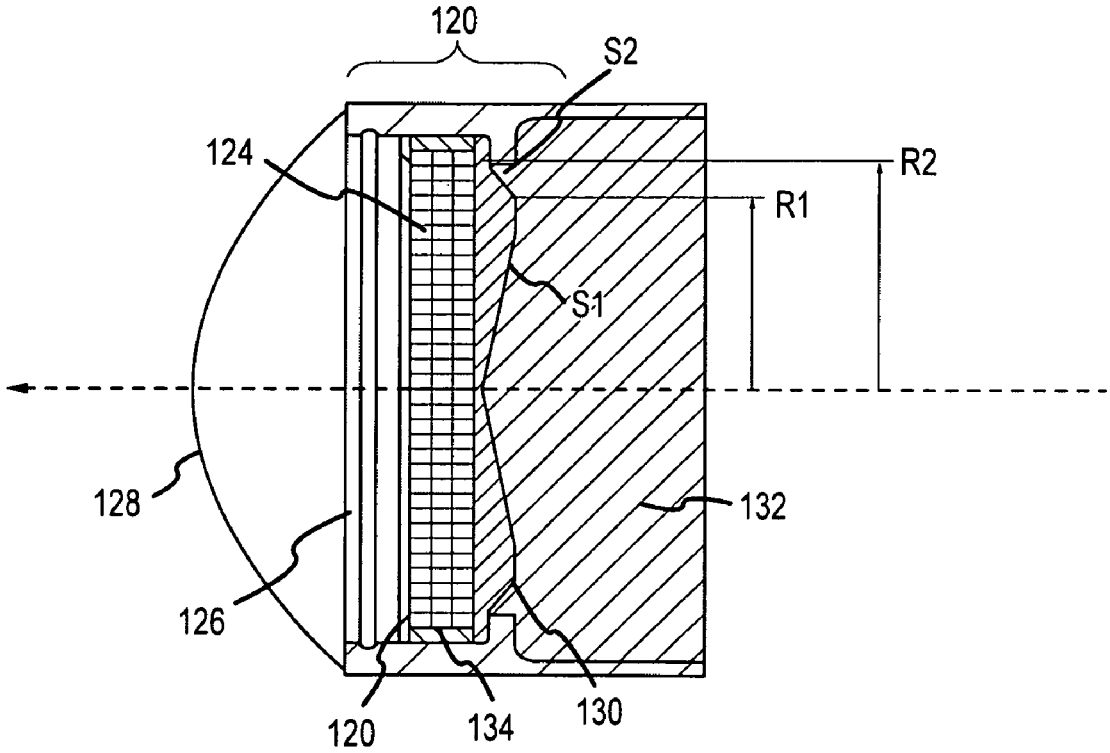

Different embodiments of the forward-firing fragmentation assembly are depicted in FIGS. 5*a* through 5*c*. As shown in FIG. 5*a*, the length of containment ring 56 is extended forward to overlap a portion of dome-shaped layer 52. In this configuration, the configuration ring will contain the pressure wave, directing the front of the wave in the forward direction thereby reducing the half-angle.

A shown in FIG. 5*b*, a variable-thickness pattern shaper 110 is placed between the end 40 of explosive 38 and dome-shaped layer 52 to augment the pattern shaping. Note, in this case the dome-shaped end 40 of explosive 38 is flattened in the center 112 and only approximately conformal with dome-shaped layer 52. The pattern shaper 110 is conformal with the dome-shaped layer. As the pressure wave reaches pattern shaper 110 it travels relatively faster in the peripheral regions 114 and 118 on either side of the center 112 because explosive 38 continues to detonate. Once the wave goes through the thickest part of the pattern shaper it slows down more than the wave going through the thinnest part. The result is that the pattern shaper slows down the center fragments and focuses the fragments, more in a straight line. How much the wave slows down is dictated by the shock impedance of the shaper material which is a function of the material's density and the speed of sound in the material and the thickness of the pattern shaper. Lower density materials such as composites are generally preferred because they absorb less energy. However, higher density materials can have a smaller volume leaving more space for explosive. The range of materials suitable for the shaper includes fiber reinforced composites, thermoplastic (resin, polymer), nylon, rubber, stereolithographic (SL) materials, structural foams, and metals. The only qualification is that it be either castable or machinable. In general, we want to minimize or even eliminate any material between the explosive and the fragmentation layer to maximize the energy imparted to the fragments. However, in some cases the pattern shaper may provide the best balance of pattern shape and uniformity with velocity. Also, if desired the pattern shaper can delay the release of the forward fragments to affect the timing between the forward and side-firing patterns.

FIG. 5*c* illustrates a forward-firing fragmentation assembly 120 that utilizes a flat fragmentation layer 122. Fragments 124 are cast in an epoxy or held in a cup that is pulverized upon detonation. A layer 126 such as RTV holds the assembly in place. A nose cone 128 is positioned on the front of the warhead for aerodynamics. A pattern shaper 130 is placed between the fragment layer 126 and a conformally shaped surface of the explosive 132. The interface between the explosive and the pattern shaper changes the relative velocities of a propagating pressure wave across an aft surface of the fragmentation assembly 120 to shape the pattern density of expelled metal fragments. In the embodiment shown, the conformal aft surface of the pattern shaper has a concave conical shape with radius R1 and slope S2 and a concave annular shape around the periphery starting at radius R2 with slope S2. This non-planar interface progressively slows the propagation velocity of the pressure wave with increasing radius from the long body axis up to a radius R1 and progressively increases the propagation velocity of the pressure wave with increasing radius from a radius R2>R1 so that the number of expelled fragments per unit area is approximately uniform over a prescribed solid angle upon detonation of the explosive. Retaining ring 134 placed around the periphery and at least coextensive with fragmentation layer 120 provides confinement albeit for a few microseconds that emphasizes the expelled fragments axial velocity over their radial velocity. The design of the retaining ring and the concave annular shape of the pattern shaper are jointly optimized to bring the tails of the distribution of the expelled fragments in to the prescribed solid angle.

Figure 6:
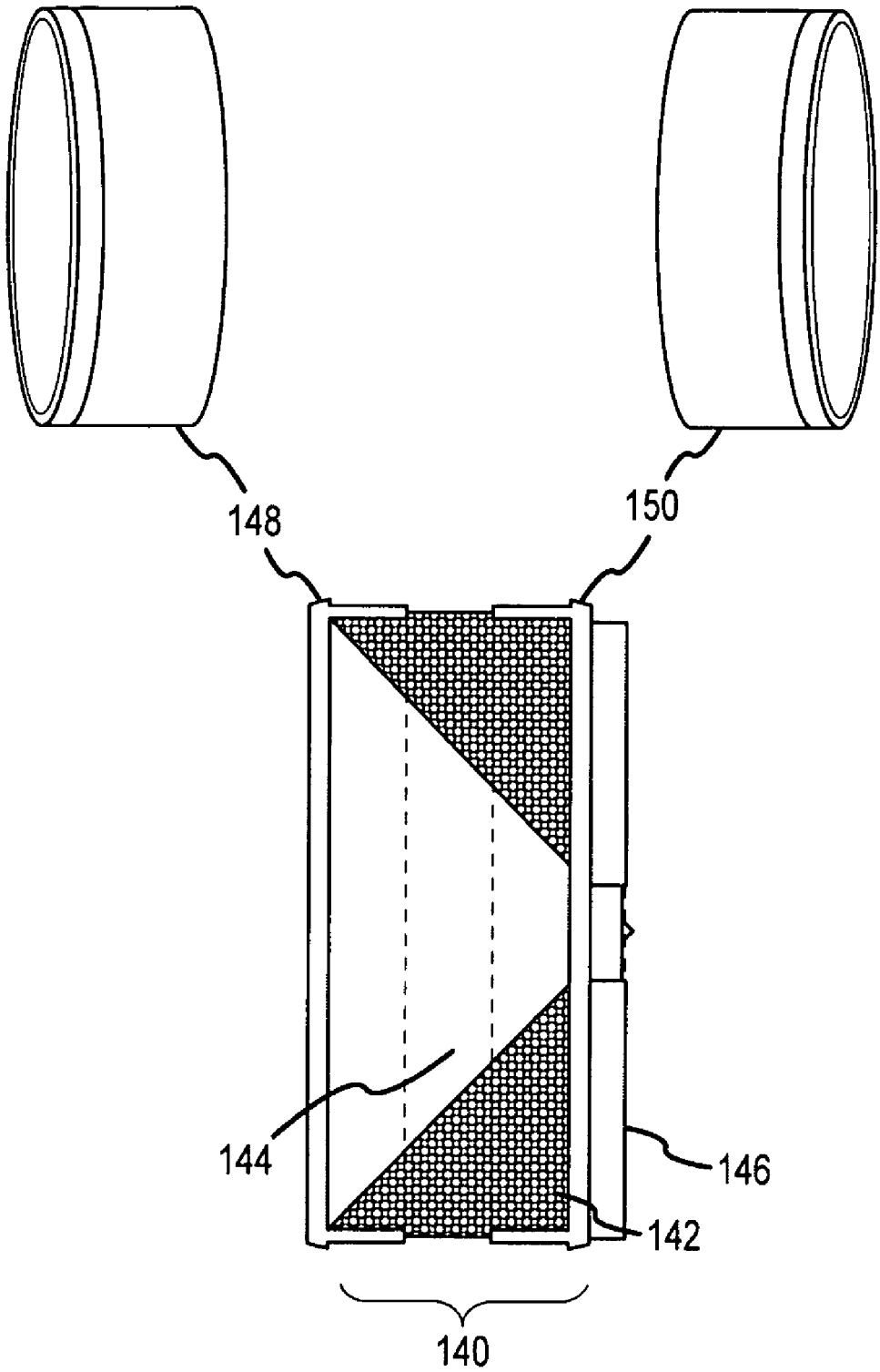
FIG. 6 is a diagram of an embodiment of the side-firing fragmentation assembly to control the half-angle of the side-firing pattern.

FIG. 6 depicts an embodiment of a side-firing fragmentation assembly 140 that includes different mechanisms for confining the expelled metal fragments 142 to a desired side-firing pattern or "half-angle". As previously shown in FIG. 3*d*, the pressure wave provides the energy to expel the fragments in a generally sideways direction. These mechanisms primarily serve to confine or control the expelled fragments for a desired half-angle. First, the taper of the containment structure 144 serves to direct fragments laterally. Second, a mass aft of the explosive, either the interceptor itself or a steel base plate 146 reflects the pressure wave forwards and laterally. Third, one or more containment rings 148 and 150 can be positioned fore and aft of the assembly 140 to shape the pressure wave.

Figure 7A:
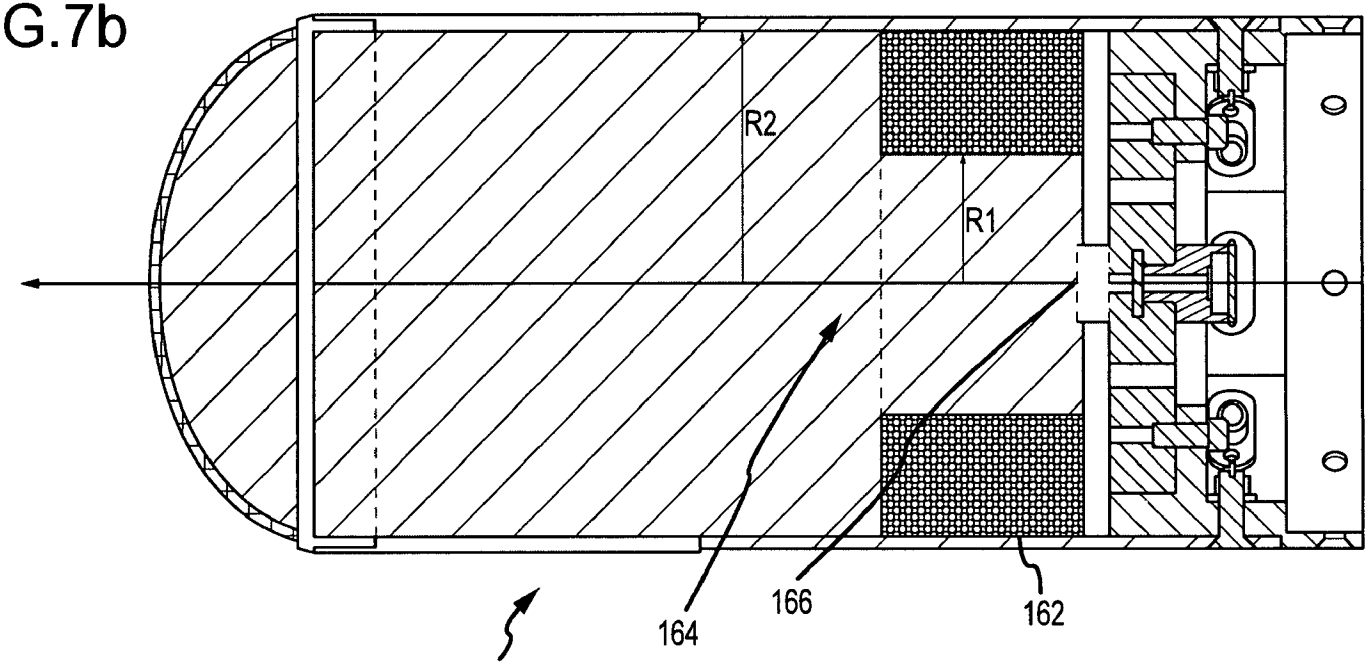
FIGS. 7*a* and 7*b* are side section and bottom views of an alternate embodiment of a dual-mass forward and side firing fragmentation warhead.
Figure 7B:
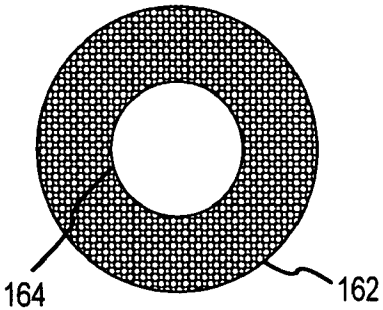

As shown in FIGS. 7*a* and 7*b*, in an alternate embodiment of a dual-mass warhead 160 a side-firing fragmentation assembly fills an annular void space with fragments 162. In this case, the diameter of the explosive 164 steps from R1 in the aft section of the warhead in front of initiator 166 to the case diameter R2. From a space utilization/wave propagation standpoint this configuration is not optimal. However, the threat scenario may dictate a differently shaped side-firing pattern or distribution of fragments in the pattern that is better served by this configuration. Other configurations of the forward and side-tiring fragmentation assemblies are envisioned to address different warhead designs and threat scenarios without departing from the scope of the present invention.

Figure 8:
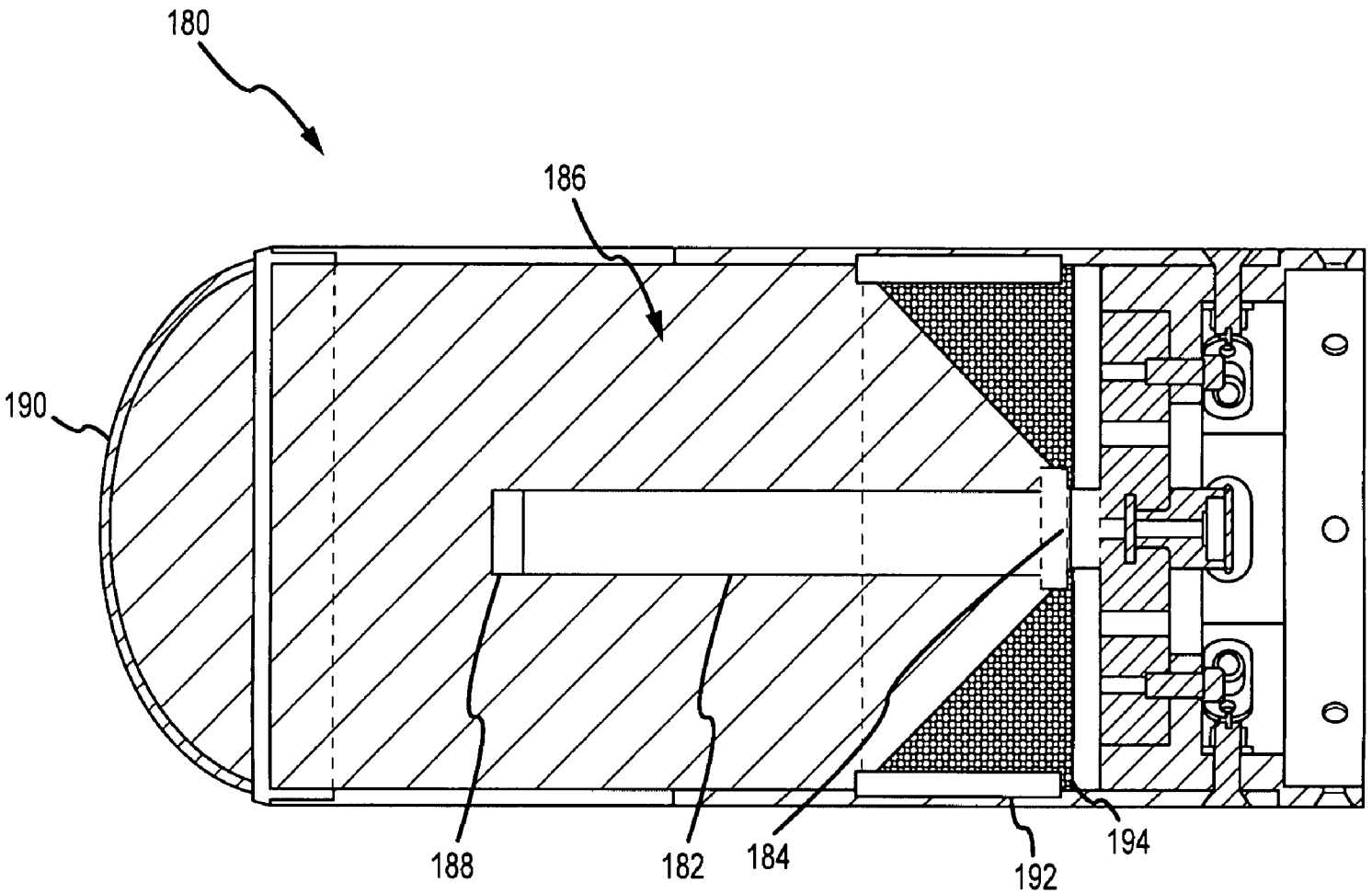
FIG. 8 is a side section view of an alternate dual-initiation embodiment of the dual-mass warhead.

As shown in FIG. 8, in an alternate embodiment of a dual-mass warhead 180 a shock tube 182 is placed along the long axis of the warhead to couple the primary detonator charge 184 positioned at the aft end of the tapered explosive 186 to a secondary detonator charge 188 positioned in the central or fore section of the explosive. When primary detonator charge 184 is initiated, the pressure wave will travel through shock tube 182 faster than it does through the explosive thereby triggering a secondary explosion so that the front of the pressure wave reaches and expels the fragments in the dome-shaped fragmentation layer 190 sooner. This may be useful if the threat scenario dictates a larger delay between the detonation of the forward-firing pattern and the side-firing pattern. As shown the delay can be further increased by increasing the thickness of the casing walls 192 around the side-firing fragments 194 thereby momentarily delaying their release. Other dual-initiation schemes may be envisioned to delay the side-firing pattern.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A dual-mass warhead, comprising:

a case formed of a material that is pulverized upon detonation;

an explosive containment structure inside the case, said containment structure having an aft section that defines a space between the case and the containment structure;

an explosive in the explosive containment structure;

an initiator to initiate detonation of the explosive;

a side-firing fragmentation assembly including first metal fragments in the space that expels the first metal fragments in a side-firing pattern upon detonation of the explosive; and a forward-firing fragmentation assembly including second metal fragments positioned fore of the explosive that expels the second metal fragments in a forward-firing pattern upon detonation of the explosive, wherein the expulsion of said first metal fragments from the side-firing fragmentation assembly in the side-firing pattern is delayed with respect to the expulsion of said second metal fragments from the forward-firing fragmentation assembly in the forward-firing pattern, and wherein the expulsion of said first and second metal fragments creates a central region of the firing pattern between the forward and side-firing patterns largely devoid of said first and second metal fragments, occupied only by the pulverized casing materials.

2. The dual-mass warhead of claim 1, wherein the forward-firing fragmentation assembly includes a dome-shaped layer of said second metal fragments.

3. The dual-mass warhead of claim 2, wherein a fore section of the explosive has a dome-shape that is at least approximately conformal with the dome-shaped layer.

4. The dual-mass warhead of claim 3, wherein detonation of the explosive produces a pressure wave that propagates forward to expel the second metal fragments in the forward-firing pattern, said dome-shaped layer approximately matched to the shape of the front of the pressure wave.

5. The dual-mass warhead of claim 3, wherein the forward-firing fragmentation assembly further comprises a containment ring around the periphery and aft of said dome-shaped layer.

6. The dual-mass warhead of claim 5, wherein the containment ring overlaps at least an aft portion of the dome-shaped layer.

7. The dual-mass warhead of claim 3, further comprising a variable-thickness pattern shaper between the dome-shaped layer of second metal fragments and the explosive.

8. The dual-mass warhead of claim 1, wherein the forward-firing fragmentation assembly comprises:

a layer of pre-formed second metal fragments; and a containment ring around the periphery of at least a portion of the layer.

9. The dual-mass warhead of claim 1, wherein the initiator includes a first detonator to initiate detonation of the explosive at the aft section of the warhead and a second detonator to initiate detonation of the explosive towards the fore section of the warhead.

10. The dual-mass warhead of claim 1, wherein said pulverized case material has a mass efficiency no greater than 1%, said expelled first and second metal fragments from said side-firing and forward-firing fragmentation assemblies each having a mass efficiency of at least 70%.

11. The dual-mass warhead of claim 1, wherein said forward-firing fragmentation assembly expels the second metal fragments in said forward-firing pattern in a half-angle of between approximately 3 and 45 degrees about a long axis of the warhead and said side-firing fragmentation assembly expels said first metal fragments in said side-firing pattern in a half-angle of between approximate 10 and 45 degrees about an axis approximately orthogonal to said long axis.

12. The dual-mass warhead of claim 1, wherein said forward-firing fragmentation assembly comprises a number of pre-formed second metal fragments of a size and said side-firing fragment assembly comprises a larger number of pre-formed first metal fragments of a smaller size.

13. The dual-mass warhead of claim 1, wherein the detonation of the explosive is initiated at a point within the explosive that is closer to the forward-firing fragmentation assembly than to the side-firing fragmentation assembly to delay the expulsion of said first metal fragments from the side-firing fragmentation assembly in the side-firing pattern with respect to the expulsion of said second metal fragments from the forward-firing fragmentation assembly in the forward-firing pattern.

14. The dual-mass warhead of claim 1, wherein said forward-firing and side-firing fragmentation assemblies are spaced apart by a central section of the case that is pulverized upon detonation.

15. A dual-mass warhead of, comprising a case formed of a material that is pulverized upon detonation;

an explosive containment structure inside the case, said containment structure having an aft section that defines a space between the case and the containment structure;

an explosive in the explosive containment structure;

an initiator to initiate detonation of the explosive;

a side-firing fragmentation assembly including first metal fragments in the space that expels the first metal fragments in a side-firing pattern upon detonation of the explosive; and a forward-firing fragmentation assembly including a layer of pre-formed second metal fragments positioned fore of the explosive that expels the second metal fragments in a forward-firing pattern upon detonation of the explosive, a containment ring around the periphery of at least a portion of the layer and a pattern shaper of variable thickness between the layer of pre-formed second metal fragments and the explosive.

16. A dual-mass warhead, comprising:

a case formed of a material that is pulverized upon detonation;

an explosive containment structure inside the case, said containment structure having an aft section that defines a space between the case and the containment structure;

an explosive in the explosive containment structure, wherein the aft section of the containment structure and the explosive tapers from a first diameter approximately equal to the inner dimension of the case to a second smaller dimension at an aft end of the explosive;

an initiator positioned aft to initiate detonation at the aft end of the explosive;

a side-firing fragmentation assembly including first metal fragments in the space that expels the first metal fragments in a side-firing pattern upon detonation of the explosive; and a forward-firing fragmentation assembly including second metal fragments positioned fore of the explosive that expels the second metal fragments in a forward-firing pattern upon detonation of the explosive.

17. The dual-mass warhead of claim 16, wherein detonation of the explosive produces a pressure wave that propagates forward through the tapered explosive to expel the second metal fragments in the forward-firing pattern, wherein the taper from the first to the second diameter is optimized to maximize the space without reducing the total explosive energy imparted to the second metal fragments.

18. The dual-mass warhead of claim 16, further comprising a base plate aft of the explosive, said tapered aft section of the containment structure and said base plate configured to reflect the pressure wave of the detonated explosive forward towards the forward-firing fragmentation assembly and to direct the first metal fragments expelled from the side-firing fragmentation assembly in the side-firing pattern.

19. The dual-mass warhead of claim 16, further comprising at least one containment ring around the periphery of side-firing fragmentation assembly.

20. A dual-mass warhead, comprising:

a case having a fore section with an opening;

an explosive containment structure inside the case, said containment structure having a fore section with a diameter conformal with said case and having a tapered aft section that tapers to a reduced diameter to define a tapered void space between the case and the containment structure, said case and containment structure formed of materials that are pulverized upon detonation with a mass efficiency no greater than 1% an explosive in the explosive containment structure, said explosive having a fore section with a diameter conformal with said case and a dome-shape end and an aft section that tapers to said reduced diameter;

a side-firing fragmentation assembly including a volume of pre-formed first metal fragments in the tapered space that expels said pre-formed first metal fragments in a side-firing pattern with a mass efficiency of at least 70% upon detonation of the explosive;

a forward-firing fragmentation assembly positioned in the opening fore of the explosive including a dome-shaped layer of pre-formed second metal fragments that expels the second metal fragments in a forward-firing pattern with a mass efficiency of at least 70% upon detonation of the explosive; and an initiator to initiate detonation of the explosive at a point that delays the expulsion of the first metal fragments in the side-firing pattern relative to the expulsion of the second metal fragments in the forward-firing pattern, wherein the expulsion of said first and second metal fragments creates a central region of the firing pattern between the forward and side-firing patterns largely devoid of said first and second metal fragments, occupied only by the pulverized casing materials.

21. The dual-mass warhead of claim 20, wherein detonation of the explosive produces a pressure wave that propagates forward through the tapered explosive to expel the second metal fragments in the forward-firing pattern, wherein the taper from the first to the second diameter is optimized to maximize the void space without reducing the total explosive energy imparted to the second metal fragments and wherein said dome-shape layer is approximately matched to the shape of the front of the pressure wave incident thereon.

22. The dual-mass warhead of claim 20, wherein said forward-firing fragmentation assembly comprises a first containment ring around its periphery and aft of said dome-shaped layer of pre-formed metal fragments and said side-firing fragmentation assembly comprises a second containment ring around its periphery fore of the pre-formed fragments.

23. The dual-mass warhead of claim 22, further comprising a variable-thickness pattern shaper between the dome-shaped layer and the explosive.

24. The dual-mass warhead of claim 20, wherein detonation of the explosive is initiated at a point closer to the forward-firing fragmentation assembly than to the side-firing fragmentation assembly.

25. A dual-mass warhead, comprising:

a case formed of a material that is pulverized upon detonation, said case having a long axis;

an explosive containment structure inside the case, said containment structure having an aft section that defines a space between the case and the containment structure;

an explosive in the explosive containment structure;

an initiator to initiate detonation of the explosive;

a side-firing fragmentation assembly including first metal fragments in the space around an aft portion of the explosive that expels the first metal fragments in a side-firing pattern in a first half-angle about an axis approximately orthogonal to said long axis upon detonation of the explosive; and a forward-firing fragmentation assembly including second metal fragments positioned fore of the explosive that expels the second metal fragments in a forward-firing pattern in a second half-angle about said long axis upon detonation of the explosive, wherein a central region of the firing pattern between the forward and side-firing patterns is largely devoid of said first and second metal fragments, occupied only by the pulverized casing materials.

26. The dual-mass warhead of claim 25, wherein detonation of the explosive is initiated at a point so that the expulsion of the first metal fragments in the side-firing pattern is delayed with respect to the expulsion of the second metal fragments in the forward-firing pattern.

27. A dual-mass warhead, comprising:

a case formed of a material that is pulverized upon detonation;

an explosive containment structure inside the case, said containment structure having an aft section that defines a space between the case and the containment structure;

an explosive in the explosive containment structure;

a side-firing fragmentation assembly including first metal fragments in the space that expels the first metal fragments in a side-firing pattern upon detonation of the explosive;

a forward-firing fragmentation assembly including second metal fragments positioned fore of the explosive that expels the second metal fragments in a forward-firing pattern upon detonation of the explosive, and an initiator to initiate detonation of the explosive at a point that delays the expulsion of the first metal fragments in the side-firing pattern relative to the expulsion of the second metal fragments in the forward-firing pattern.

* * * * *